United States Patent [19]

Darvishian

[11] 4,154,393

[45] May 15, 1979

[54] SECURITY MAILBOX

[76] Inventor: Arthur Darvishian, 5314 Sheridan Dr., Williamsville, N.Y. 14221

[21] Appl. No.: 654,698

[22] Filed: Feb. 2, 1976

Related U.S. Application Data

[63] Continuation-in-part of Ser. No. 400,535, Sep. 25, 1973, Pat. No. 3,935,994.

[51] Int. Cl.[2] ..... B65D 91/00

[52] U.S. Cl. ..... 232/36; 232/17; 340/569; 179/1 H

[58] Field of Search ..... 232/17, 36, 37; 200/61.63; 340/281, 224; 179/1 H, 1 C

[56] References Cited

U.S. PATENT DOCUMENTS

| | | | |
|---|---|---|---|
| 1,342,468 | 6/1920 | Smith et al. | 340/281 |
| 1,482,459 | 2/1924 | Cahan | 232/38 |
| 1,781,282 | 11/1930 | Hulett | 232/36 |
| 2,016,036 | 10/1935 | Fitzgerald | 340/224 |
| 2,076,017 | 4/1937 | Casper | 340/281 X |
| 2,076,176 | 4/1937 | Davidson | 179/1 H |
| 2,452,667 | 11/1948 | Lambert | 232/17 X |
| 2,477,379 | 7/1949 | Korth | 232/36 X |
| 2,921,734 | 1/1960 | Whildin et al. | 232/36 |
| 3,150,361 | 9/1964 | Conigliaro | 200/61.63 |
| 3,184,730 | 5/1965 | Irish | 340/274 X |
| 3,275,229 | 9/1966 | Turner | 232/34 |
| 3,284,571 | 11/1966 | Wittig | 179/1 H |
| 3,295,124 | 12/1966 | Burleson | 340/281 |
| 3,935,994 | 2/1976 | Darvishian | 232/36 |

*Primary Examiner*—Roy D. Frazier
*Assistant Examiner*—Peter A. Aschenbrenner
*Attorney, Agent, or Firm*—Raymond F. Kramer

[57] ABSTRACT

A mailbox for the reception and protection of mail comprises a mail receptacle or container with a door, an alarm system control switch, responsive to the opening and closing of the mailbox door to activate an alarm when the door is open, illuminating means to light an area near the mailbox and intercommunication means for identification of and conversation with a caller or person using the mailbox. The mentioned security features of the mailbox are components of a pre-wired unit and installation is thereby greatly simplified and facilitated.

10 Claims, 3 Drawing Figures

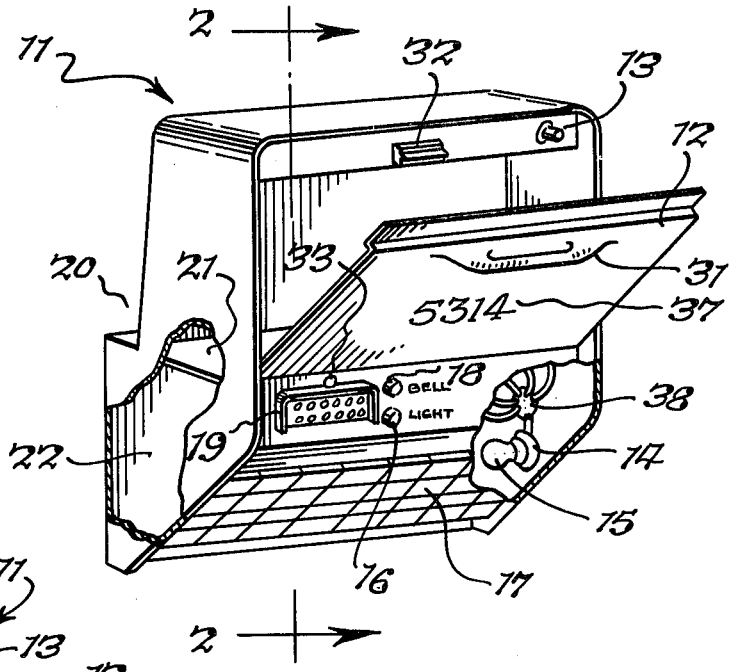
Fig. 1.
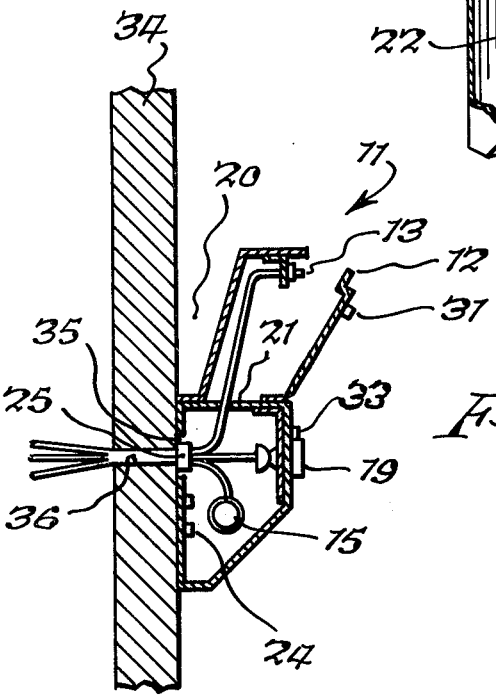
Fig. 2.
Fig. 3.
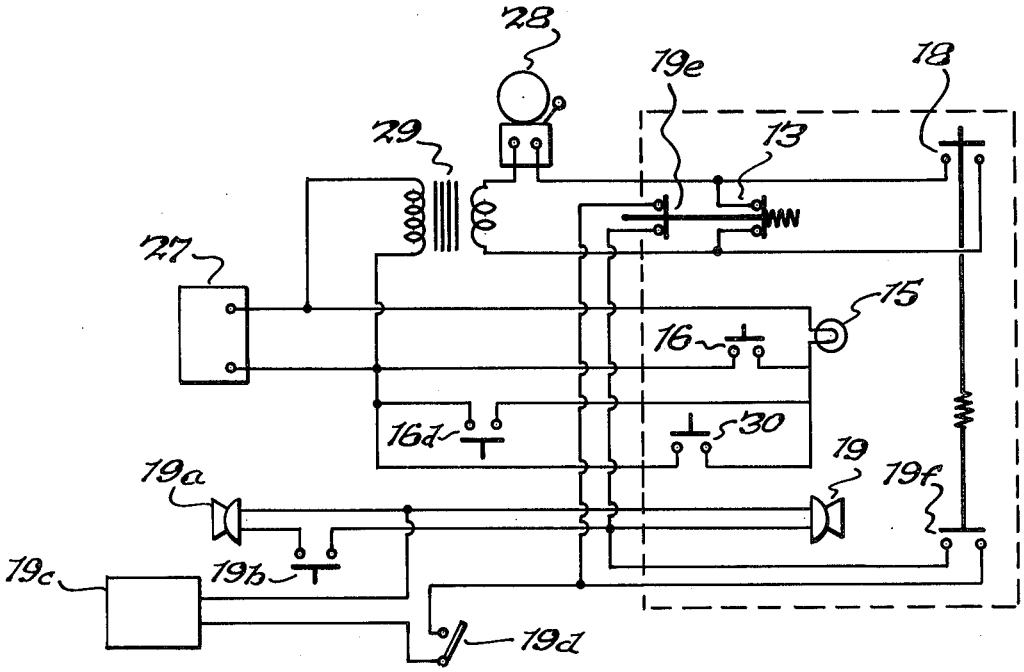

SECURITY MAILBOX

This application is a continuation-in-part of my copending application Ser. No. 400,535 for Security Mailbox, filed on Sept. 25, 1973, now U.S. Pat. No. 3,935,994, issued Feb. 3, 1976.

This invention relates to a novel and useful security mailbox which provides a substantial convenience for the owner and legitimate users thereof while at the same time affording a high degree of protection for the mail deposited therein and additional protection for the home where it is installed, by providing a means for detecting and discouraging the presences of thieves, prowlers and unauthorized persons.

Mail thieves, prowlers and vandals are common problems for home and apartment dwellers in urban as well as suburban and rural communities. Various devices which activate alarms upon the openings of mailboxes are known. However, although such systems provide signals to notify the owner that the mailbox has been opened, they generally fail to provide a means for the identification of the user and thus do not provide for distinguishing between legitimate use of the mailbox, such as in the deposit of mail, and undesired use, such as by a prowler or thief. Furthermore, the mailbox alarm systems of the prior art do not provide illumination in the vicinity of the mailbox and means by which the owner may communicate from within his dwelling with a person who is opening the box or is in the vicinity thereof. If such systems or features are desired they are installed separately, presenting the problems of finding suitable locations on a dwelling outside wall for such installation and requiring additional installation expenses for labor and materials.

It is a primary object of the present invention to provide a security mailbox comprising a combination of features which provide convenience for the owner as well as legitimate users while at the same time providing a means for detecting and discouraging mail theft and the presence of prowlers or other undesirable persons on the premises. It is also an object to include such advantageous features in a unitary construction which is convenient and economical to install and is attractive in appearance. It is a further object to provide ample means for the protected temporary storage of mail and additional and separate means for holding magazines, newspapers, circulars and catalogs.

Other objects, advantages and features of the present invention will become apparent to those skilled in the art from the following description, taken in conjunction with the accompanying drawing, in which:

FIG. 1 is a partially cutaway perspective view of a security mailbox of this invention, mounted on an exterior wall of a dwelling;

FIG. 2 is a sectional elevation of the mailbox mounted on the wall, taken along plane 2—2 of FIG. 1; and FIG. 3 is a schematic electrical diagram of a mode of the invention together with associaed illuminating means, intercom, remote alarm, controls and power supply, wherein activation of the illuminating means and the intercom are controlled by the opening and closing of the mailbox door.

In FIG. 1, the mailbox unit 11 of the present invention is shown with hinged door 12 in a partly open position. A handle 31 is provided to facilitate opening of the door and catch means 32, cooperating with similar means on the door, holds it closed until it is opened by application of the requisite force to the handle. A space is provided on the door or other front face part of the box for house numerals 37, occupant identification, etc. A switch 13, which may be a microswitch or other suitable switch of the normally closed type, is mounted in such a manner as to be responsive to the opening and closing of the door, closing a circuit when the door is opened. As will be apparent from FIG. 3, switch 13 activates a remote audio, visual or other suitable type of alarm, usually located in the dwelling. However, it is within the invention to have the alarm located in or adjacent to the mailbox or to have a plurality of dwelling and/or mailbox alarms. In the interior of the mailbox under base or shelf 21 are located lamp socket 14 and light bulb 15. They may be energized by pressing of pushbutton switch 16 mounted on the face of the box, or by actuation of another suitable switch, located in the dwelling or elsewhere. A transparent or translucent panel 17, preferably of a synthetic organic plastic, e.g., nylon, polystyrene, polyacrylate, polyethylene or polypropylene or of glass, allows for transmission of light from light bulb 15 to the region around the mailbox. This light acts as a courtesy light, helping in illuminate the area about a dwelling entrance and helps to discourage prowlers or assists in their identification. The lighting means may be of the incandescent bulb or fluorescent tube type. The panel may be removable, for cleaning, bulb replacement or repairs. A push-button switch 18 for activation of a remote doorbell or other communication means may also be located in the mailbox or mounted on the box, suitably on the front panel thereof.

The front panel of the mailbox also provides a location for mounting at an intercommunication transmitter-speaker station 19, controllable from a remotely-located master station, not shown. In some cases it may be a master station, too.

The upper portion of the back of the mailbox may be recessed to provide a deposit space, as shown at 20, for newspapers and the like. A downwardly and inwardly sloping wall for it, extending downwardly for about half the height of the box, is preferred, as illustrated. In the cutaway portion at the left of the drawing of FIG. 1 and behind the open door is shown the base or shelf 21 of the mail storage area. Base 21 may be formed of the same material as the outside of the mailbox, for example, painted or unpainted metal or opaque synthetic organic polymeric plastic, wood, etc., or may be made of a transparent or translucent material such as glass or a plastic like those previously mentioned for the panel 17. It will be apparent that if the shelf 21 is made of a transparent or translucent material or if openings are provided therein the courtesy light source 15 may serve to illuminate the interior of the box as well as the exterior, thereby providing a greater degree of convenience to the authorized user.

Within the lower interior portion of the mailbox space is provided for the optional installation of additional security devices. For example, in this region, designated 22, a detection unit of the ultrasonic, infrared, photoelectric or other suitable type for the detection of persons in the vicinity of the mailbox may be located. A sensor external part 33, e.g., a photoelectric cell part connected to the other parts of such a detection unit, may respond to interruption of a light beam directed onto it to signal the presence of a visitor, prowler or thief even before any physical contact is made by such person with the mailbox door.

In FIG. 2, a typical installation of mailbox unit 11 on an outer wall 34 of a swelling is shown which uses fastening means such as screws 24, nails, bolts or the like. Alternatively, a track or mounting bracket may be fastened to the dwelling wall and the mailbox may be mounted on it. In the drawing, the newspaper storage area 20 is bounded by the recessed portion of the back of the mailbox and the wall 34 of the house, thus providing a convenient repository for newspapers or other articles too bulky for deposit within the mailbox. The wirings for the alarm switch 13, light 15 and intercom 19 are led through opening 35 in the box, which is aligned with bored hole 36 in the dwelling wall, so that connections may be made to the power supply and signalling and other devices in the dwelling. Jacks and mating parts may be used to facilitate connections. It will be appreciated that the exact location of a wiring outlet or outlets on the mailbox is not critical and the most convenient location will usually be chosen. For this reason the wiring passages and the jack assembly 25 shown in FIG. 2, are intended to be illustrative but not limiting and terminal boards may be used instead, as illustrated in FIG. 1 at 38.

In FIG. 3, a schematic diagram of the electrical features of one mode of the present invention is shown. Features and associated wiring that form a part of the mailbox unit are shown within the dashed lines and are electrically connected to a remotely located power supply 27, alarm bell 28, transformer 29 and intercom master station 19*a*. The intercom may be controlled at master station 19*a* and is activated by switch 19*b* from inside the dwelling. Electric light 15 may be activated either by means of switch 16 on the mailbox or remote switch 16*d*. It will be understood that in place of or in addition to the bell-type alarm 28 a visual alarm, such as an electric light, may be used. Light bulb 15 is also actuatable by switch 30 which is advantageously mounted on the box in such manner as to be responsive to the opening and closing of the mailbox door, or which may be replaced by switch 13, adapted to set off alarm 28 and light bulb 15 when the door is opened. Thus, the region in and around the mailbox may be illuminated when the door is opened. Again the dual purposes of convenience and protection are served. On opening the mailbox after dark, the illumination provides a convenience for the legitimate user of the mailbox and tends to discourage or frighten away a thief or prowler by illuminating his activities. The various additional described devices may be similarly wired to be activated by single or several switches in accord with the previous instructions and code wiring practices.

In the preferred embodiment of the invention illustrated in FIG. 3 operation of the intercom is shown controlled by a master switch inside of the dwelling or at other suitable location, with an auxiliary actuating switch inside the dwelling and switches responsive to the opening of the mailbox door and to operation of the bell button on the mailbox. A separate source of electricity, preferably of direct current, is illustrated at 19*c*, which is connected to one leg of an electrical line of the intercom circuit. However, the other line is not actuated unless master switch 19*d* is closed and in addition, at least one of switches 19*b*, 19*e* and 19*f* is also closed. Thus, when master switch 19*d* is closed and the householder closes switch 19*b* he may communicate via the intercom with a visitor at the mailbox or he may listen to any sounds emanating from the area around the mailbox. When master switch 19*d* is closed and the mail box is opened, as shown, switch 19*e* is closed (switch 13 is also closed), actuating the intercom. Bell 28, activated by switch 13, may be one of only a controlled, limited period of operation and the period of operation for the intercom may be a longer period or may be the entire period in which the mailbox door is opened. If the mailbox door remains closed and internal switch 19*b* is opened the intercom may still be activated by means of switch 19*f*, which closes the intercom circuit when bell button 18 is depressed, also closing the bell circuit. As illustrated, the bell is in operation only while bell button 18 is held depressed but the intercom switch, being of a type requiring two "depressions" or "activations" for return to initial condition, remains closed so that a conversation may be conducted between the householder and the visitor. The intercom may then be disconnected when the visitor leaves by an additional momentary depression of button 18. A light may be provided in the home to indicate when the intercom is activated. Also within the invention is the provision of a switch of the type of switch 19*f* in place of switch 19*e* so that the intercom, activated by opening of the mailbox door, will still be active after closing of the door (another opening and closing will be required to inactivate the intercom).

In the illustrations switches 16 and 18 are of the push-button type. However, other switches such as toggle, mercury, radio-operated and knife switches, etc., may be employed. Similarly, although the electric light means 15 has been shown as an incandescent bulb, other lighting means, including electro-luminescent devices, may be employed. In the diagram, the door-activated alarm switch utilizes the same alarm and circuitry as the door-bell. However it will be apparent that separate alarm means and circuits therefor can be employed, if desired. Although the intercom device is shown as a wired system, it will be understood that other types of intercoms, such as the wireless type, may be employed.

Various modifications of the invention may be made, without departing from its basic concepts. Thus, lights and alarms or bells may be simultaneously activated or turned on by opening of the mailbox door or may be separately activated by mailbox switches or switches in the dwelling. Both may be on high voltage, low voltage, alternating or direct current or of different voltages and current types. The intercom and the no-touch prowler detection device may be similarly operated. Shutoffs may be provided for inactivation of the various electrical parts of the mailbox unit, or for all of them when desired. Wiring locations may be varied and channels may be located in the box to provide wiring paths which do not interfere with mail insertion or removal and which facilitate making of repairs. With this teaching before him one of skill in the art will be able to design the circuits and structures accordingly.

It will be apparent that the features of the present invention serve the dual purposes of convenience and protection. For example, the door-activated alarm system switch provides a convenience to the owner by alerting him or her, through audible or visible alarm means, that mail has been deposited. On the other hand, an unauthorized opening of the mailbox will also trigger the alarm and alert the owner. The intercom provides the convenience of allowing conversing with a visitor or the mailman from some remote location within the house or apartment. In addition, when an unauthorized opening of the mailbox is suspected, the intercom permits listening to, questioning of and identification of the caller while the owner may remain safe within the house. The light provides a convenience, especially at night, enabling a caller to find the doorbell, write a note if the occupant is not at home, etc. At the same time the light, which may be controlled from within the house, can serve to illuminate the area to frighten or discourage unauthorized persons from remaining in the area. The security mailbox provides its several conveniences and protection features as a single unit which may be manufactured at a lower cost than would be the case for the separate manufacture or construction of units with such features. Since the unit is pre-wired it may be installed at a house or apartment entrance with a minumum of effort, thus affording a saving of time, money or both to the purchaser or installer. The installed product also has the various communication and identification features at a single location, making these readily locatable for the convenience of the authorized visitor. If desired a "master" switch, not shown, may be opened to shut off all power to the box and prevent prankster operations.

In a modification of the mailbox it is equipped with an unlocking device in which, by pressing a button, the householder can open a lock on the door to permit access to the mailbox. Thus, the postman may deposit the mail and then close the box, causing it to be locked by any suitable or conventional mechanism, and preventing theft of the mail. The lock may be opened in some cases by a key or may be sprung by solenoid action in response to closing a circuit by pushbutton operation. The solenoid may be operated by high or low voltage and if of the latter type the transformer for it (also useful for activating other security mailbox parts) may be located in the mailbox but preferably is in the dwelling. As with the other accessories, connections to power supply, etc., may be by soldered joint, solderless connectors, Jacks, junction blocks and terminal boards. Alternatively, a purely mechanical lock may be utilized but this is not usually preferred.

Of course, if a lock is employed there is less need for an alarm actuated by opening of the mailbox door, since said opening is usually prevented by the lock. Nevertheless, should the box not be locked, due to inadvertence or mistake or should the lock be picked, the alarm function will be useful. Also, in response to hearing or noting the alarm after deposit of mail by the postman the householder may actuate a locking mechanism to protect the mail until he or she is ready to remove it.

The described mailboxes may be made of various materials, shapes and designs to blend with the dwelling decor. Usually they are horizontally oblong with front opening doors but side and top doors are also acceptable. In some installations the mail may be removed from the box through an opening in the back of the box directly into the dwelling. In others a "peephole" device may be located in the box to allow one-way inspection of a "visitor". All such modifications are within the invention, as are other substitutes and equivalents that may be employed by one of skill in the art, after a reading of the description herein.

What is claimed is:

1. A security mailbox attachable to a wall of a dwelling, comprising a mail receptacle, door means mounted thereon for the deposit of mail into the receptacle and withdrawal therefrom when in opened position, an activating switch, responsive to opening of said door means, for activating an alarm, a support in the mail receptacle on which deposited mail rests, light transmitting means in a wall of the mailbox, illuminating means located within the mailbox so that when activated it lights an area about the mailbox at night through the light transmitting means, an intercommunication transmitter-speaker unit, mounted on a wall of the mailbox, a manually operable switch for turning on the illuminating means and a manually operable switch for activating a bell, an opening in a wall of the mailbox and wiring means passing from the interior of the mailbox through such opening and communicable with the interior of the dwelling to which the security mailbox is attachable for transmitting electric power from an external source to the alarm switch, to the intercommunication transmitter-speaker unit, to the illuminating means and to the bell switch.

2. A security mailbox according to claim 1 which includes switch means responsive to opening of the mailbox door for activating the intercommunication transmitter-speaker unit and wherein the support for deposited mail is a shelf, the intercommunication transmitter-speaker unit is mounted on the front of the mailbox below the door means and shelf thereof and is activated by the switch means responsive to the opening of the door, the wiring means is located beneath the shelf except for such means communicating with the activating switch responsive to the opening of the door, said wiring means are pre-wired in the mailbox and are communicable through the wall opening with a source of power in the dwelling to which the mailbox is attachable, the opening is in a back wall of the mailbox and the mailbox is attachable to the dwelling at the mailbox back wall.

3. A security mailbox according to claim 2 wherein the activating switch, responsive to the opening of the door to activate the intercommunication transmitter-speaker unit when the door is opened, is of a structure which maintains the intercommunication transmitter-speaker unit activated when the door is closed and requires an additional operation to inactivate said intercommunication transmitter-speaker unit.

4. A security mailbox according to claim 3 which has connected to it prowler detection means for detection of persons in the vicinity of the mailbox, which means is connected via the wiring means to an alarm.

5. A security mailbox according to claim 4 in which the back wall comprises an upper recessed wall portion which forms a storage space between such wall portion and a dwelling wall when the mailbox is affixed to said dwelling wall, suitable for holding newspapers, and a lower wall portion below said recessed wall portion of the mailbox, which is fastenable to the dwelling wall by fastening means which may be passed through the lower wall portion and in which lower wall portion is the opening through which the electric wiring means pass.

6. A security mailbox according to claim 5 wherein the activating switch, responsive to the opening of the door to activate the intercommunication transmitter-speaker unit when the door is opened, is of such structure as to maintain such intercommunication transmitter-speaker unit activated when the door is closed and require an additional operation to inactivate such intercommunication transmitter-speaker unit.

7. A security mailbox according to claim 1 which has connected to it prowler detection means for detection of persons in the vicinity of the mailbox, which means is connected via the wiring means to an alarm.

8. A security mailbox according to claim 1 in which the back wall comprises an upper recessed wall portion which forms a storage space between such wall portion and a dwelling wall when the mailbox is affixed to said dwelling wall, suitable for holding newspapers, and a lower wall portion below said recessed wall portion of the mailbox, which is fastenable to the dwelling wall by fastening means which may be passed through the lower wall portion and in which lower wall portion is the opening through which the electric wiring means pass.

9. A security mailbox according to claim 1 which includes a downwardly and inwardly angled light transmitting panel at a front bottom portion of the mailbox.

10. A security mailbox, attachable to a wall of a dwelling, comprising a mail receptacle, door means mounted thereon for the deposit of mail into the receptacle and withdrawal therefrom when in opened position, an activating switch, responsive to opening of said door means, for activating an alarm, a shelf in the mail receptacle on which deposited mail rests, light transmitting means in a wall of the mailbox, illuminating means located within the mailbox so that when activated it lights an area about the mailbox at night through the light transmitting means, an intercommunication transmitter-speaker unit, mounted on the front of the mailbox below the door means and shelf thereof, a second switch activated by opening of the door for activating said intercommunication transmitter-speaker unit, a manually operable switch for turning an the illuminating means, a manually operable switch for activating a bell, an opening in a back wall of the mailbox, which mailbox is attachable to the dwelling at the mailbox back wall, and wiring means located beneath the shelf except for such means communicating with the activating switch responsive to the opening of the door, said wiring means being pre-wired in the mailbox and passing from the interior of the mailbox through the wall opening so as to be communicable with a source of power in the interior of the dwelling to which the security mailbox is attachable, for transmitting electric power from such source of power to the intercommunication transmitter-speaker unit, to the illuminating means and to the bell switch.

* * * * *